United States Patent [19]

Burkhart et al.

[11] 4,441,821

[45] Apr. 10, 1984

[54] APPARATUS FOR INCREASING THE DELIVERY RANGE OF A MIXING AND DELIVERY AUGER TROUGH

[75] Inventors: George M. Burkhart, Strasburg, Pa.; Martin F. Dohnalik, Cortland, Ill.

[73] Assignee: Barber-Greene Co., Aurora, Ill.

[21] Appl. No.: 400,140

[22] Filed: Jul. 20, 1982 (Under 37 CFR 1.47)

[51] Int. Cl.[3] ..... B28C 7/16

[52] U.S. Cl. ..... 366/61; 193/10; 193/15; 366/68; 366/194; 366/606

[58] Field of Search ..... 366/6, 10, 13, 26, 41, 366/42, 50, 64, 68, 77, 79, 96–99, 184, 186, 194–196, 318, 606; 193/10, 2 R, 15

[56] References Cited

U.S. PATENT DOCUMENTS

| | | | |
|---|---|---|---|
| 3,310,293 | 3/1967 | Zimmerman | 366/6 |
| 3,542,179 | 11/1970 | Prichard | 193/10 |
| 3,774,741 | 11/1973 | Johnson | 193/10 |

*Primary Examiner*—Timothy F. Simone
*Attorney, Agent, or Firm*—Holman & Stern

[57] ABSTRACT

A mixing and delivery system for concrete or the like wherein the delivery range of a mixing auger trough is extended by two (2) delivery chutes which can be selectively deployed. The chutes are stored secured to and beneath the trough in end-to-end relation and are deployed by sliding the chutes lengthwise to extend beyond the trough. The chutes are pivotably engaged so that, in the deployed position, the distal trough may be pivoted out of deployment if it is not needed.

9 Claims, 6 Drawing Figures

APPARATUS FOR INCREASING THE DELIVERY RANGE OF A MIXING AND DELIVERY AUGER TROUGH

TECHNICAL FIELD

The present invention relates to mixing and delivery apparatus for concrete or the like and, in a more general sense, relates to the simultaneous mixing of individually stored and metered components while delivering the mixture to a specific location. The preferred embodiment disclosed herein relates specifically to an improvement of the mixing and delivery auger trough described and illustrated in U.S. Pat. No. 3,310,293 to Zimmerman and U.S. Pat. No. 3,339,898 to Futty, et al. The disclosures from both of these patents are expressly incorporated herein by reference in their entirety.

BACKGROUND OF THE INVENTION

The aforementioned Zimmerman patent describes a system wherein the dry concrete constituents or ingredients are stored in separate storage compartments in a mobile unit and are selectively fed in predetermined portions to a mixing trough. The ingredients are mixed with water in the trough to form concrete of a desired characteristic. The trough includes an auger extending longitudinally therethrough which is rotated by a motor to simultaneously mix the various constituents while delivering the total mixture through a trough discharge opening at the distal end of the trough. The trough is secured to the component-storing vehicle so as to be movable about both a horizontally-extending axis and a vertically-extending axis, thereby to deliver the concrete from a variety of different orientations relative to the vehicle. Since the trough is permanently secured to the vehicle, there is a limitation as to the permissible length of the trough in order for the trough to be safely and conveniently stored when not in use. This limitation on trough length has brought about the need for the attachment of delivery chutes to the end of the trough so that the concrete can be delivered to a location beyond the reach of the trough. These extension chutes are typically stored in separate locations and attached to the trough manually. This procedure, whereby the chutes are manually secured to the trough, attached to one another, adjusted in position, removed after delivery, and stored, is exceedingly time consuming. Moreover, once the chutes are loaded, changing position of the trough and chutes cannot be accomplished without removing the concrete remaining in the chutes.

SUMMARY OF THE INVENTION

It is an object of the present invention to provide an extension arrangement for a mixing and delivery trough which eliminates the need for manual attachment, adjustment, removal, and storage of the chutes for each delivery of material. It is another object of the present invention to provide an extension chute arrangement for a mixing and delivery trough which permits changing the elevation of the trough and extension chutes during a delivery. It is still another object of the present invention to provide an extension chute arrangement for a mixing and delivery trough which permits the chutes to be simply and quickly stored. Still another object of the present invention is to provide an extension chute arrangement for a mixing and delivery trough wherein one or more extension chutes can be conveniently stored and selectively deployed to increase the delivery reach of the trough.

In accordance with the present invention, delivery extension chutes are stored end-to-end beneath the mixing and delivery trough. In this storage position, the trough discharge opening is unimpeded so that concrete can freely fall therefrom to the desired location. In order to permit rapid and efficient deployment of the chutes, the chutes are slidably secured to the trough for longitudinal movement therealong. In the preferred embodiment disclosed herein, two (2) chutes are provided and have a combined length which is less than that of the trough so that the trough discharge opening remains unblocked in the chute storage position. When the chutes are deployed, both of the chutes are extended to the distal end of the trough so that one (1) chute has its ingress end disposed below the trough discharge opening. The extension chutes are pivotally engaged about a transversely-extending axis at their abutting ends so that the remote or distal chute can be pivoted up and out of the delivery flow path if not needed for a particular delivery. Thus, an operator can manually slide both chutes from their storage to their deployed positions and pivot one of the chutes out of the delivery path if it is not needed. After the delivery, the chutes can be readily washed and slid back to the storage position.

BRIEF DESCRIPTION OF THE DRAWINGS

The above and still further objects, features, and advantages of the present invention will become apparent upon consideration of the following detailed description of one specific embodiment thereof, especially when taken in conjunction with the accompanying drawings, wherein.

DESCRIPTION OF THE PREFERRED EMBODIMENT

Figure 1:
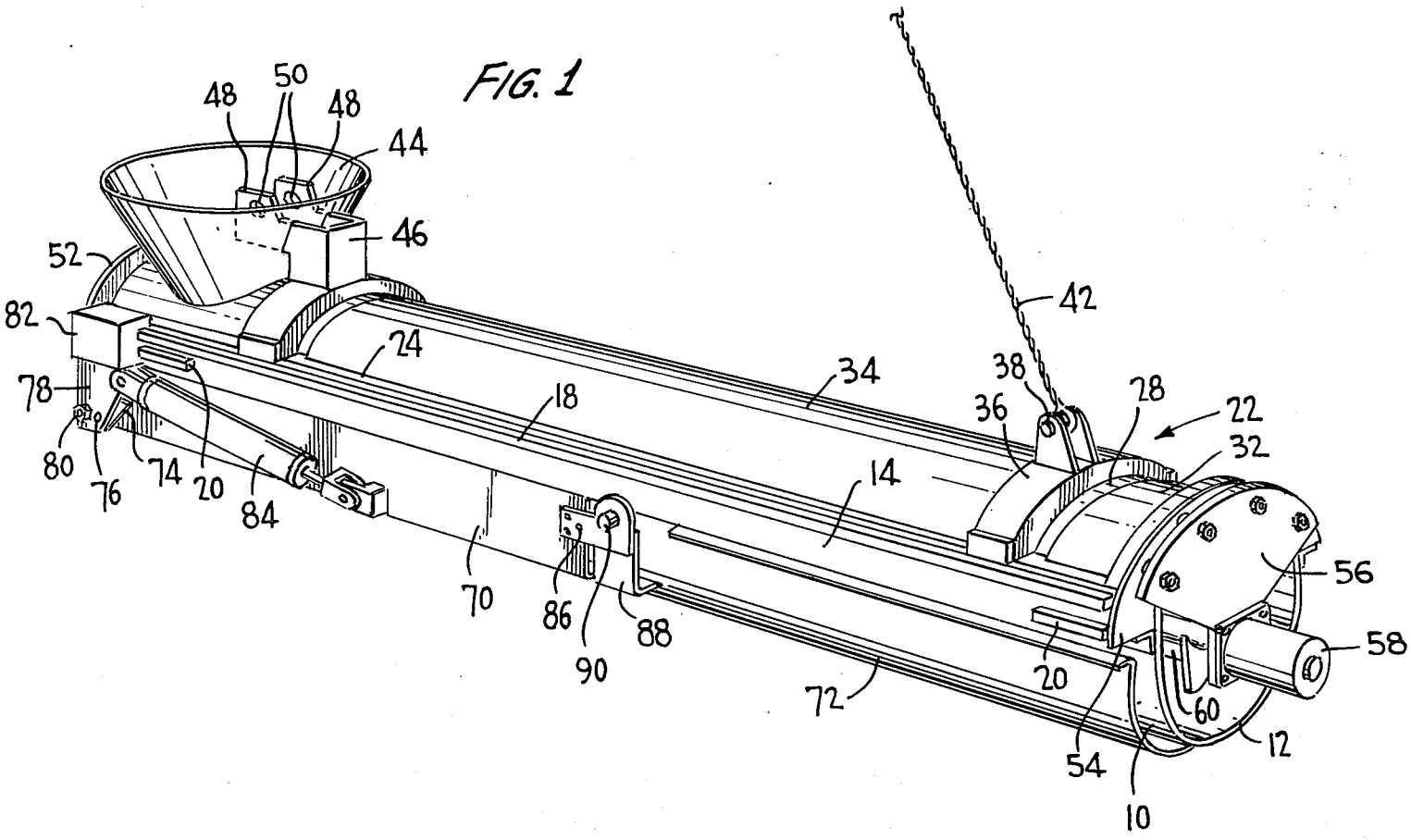
FIG. 1 is a view in perspective of the extended range mixing and delivery trough arrangement of the present invention.
Figure 2:
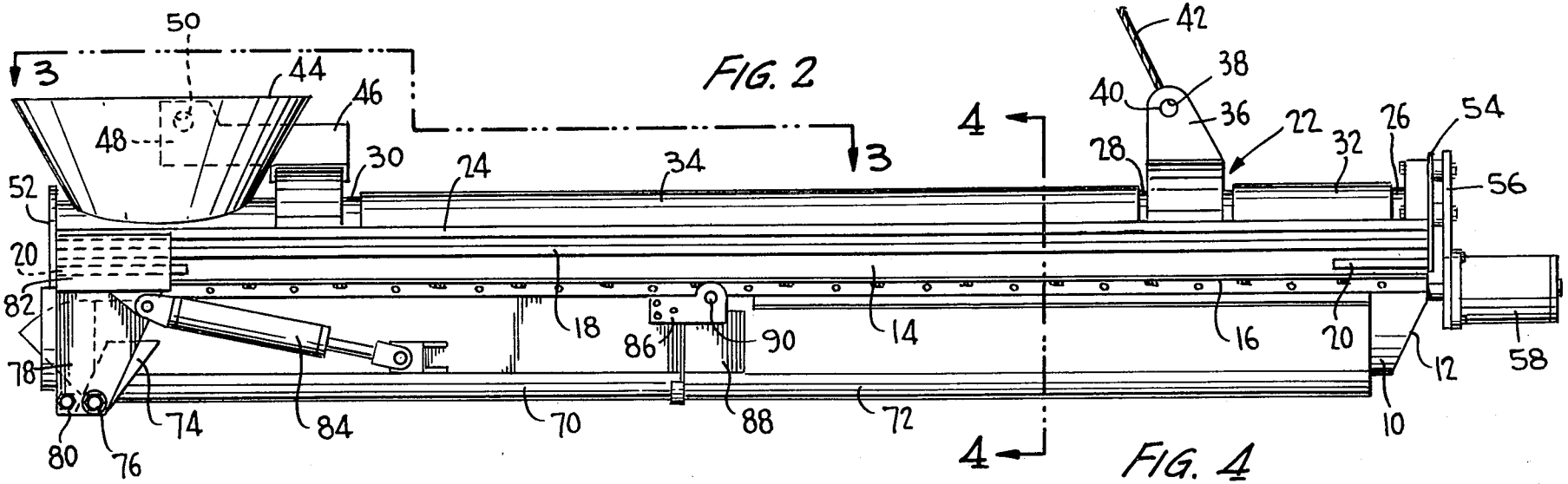
FIG. 2 is a side view in plan of the apparatus of FIG. 1.
Figure 4:
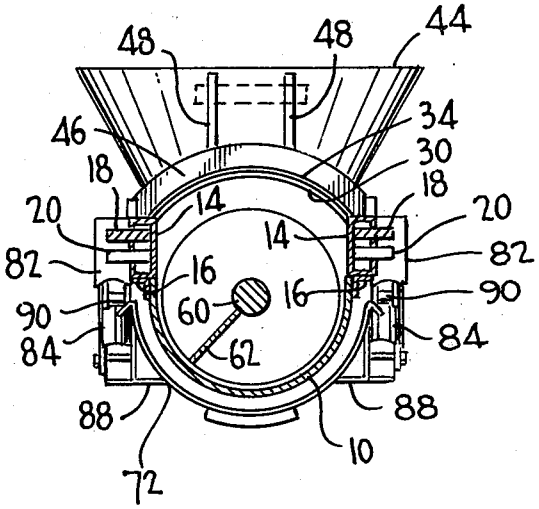
FIG. 4 is a view in section taken along lines 4—4 of FIG. 2.
Figure 3:
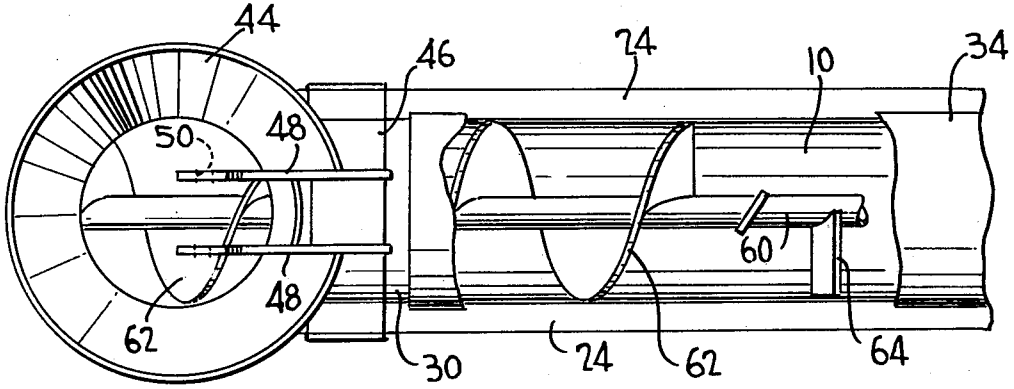
FIG. 3 is a partial top view in plan, partially broken and taken along lines 3—3 of FIG. 2.

Referring specifically to FIGS. 1–4 of the accompanying drawings, a mixing trough includes a bottom wall 10 of generally elongated configuration and having a U-shaped transverse cross-section. Bottom wall 10 is preferably made of a continuous sheet of elastomeric material for the reasons set forth in the aforementioned Futty, et al. patent. A discharge outlet 12 is formed at the discharge end of the trough by appropriately truncating a portion of the bottom trough wall 10. A pair of trough side walls 14 take the form of elongated hollow members of generally rectangular configuration which extend longitudinally along opposite sides of the trough. A pair of brackets 16 extend longitudinally, with a generally L-shaped cross-section, along the trough and are secured to respective side walls 14 and bottom wall 10 by means of suitable bolts, rivets, or the like. Brackets 16 serve to secure the side walls 14 to bottom wall 10 of the trough. A rail 18, of generally rectangular cross-section, projects through the outer surface of each side wall 14 and extends longitudinally along the entire length of each side wall. A pair of secondary rails 20 similarly project through each side wall 14 but extend longitudinally along a small portion of the length at respective ends of the trough. A cover member 22 serves as a cover or top for the trough and has a pair of longitudinally extending parallel frames 24 which rest upon and may be secured to the top of side walls 14. A first arcuate section 26 of cover 22 extends between frames 24 at the discharge end of the trough. Cover section 26 has an arcuate transverse cross-section and is longitudinally spaced from a second cross-sectionally arcuate cover section 28. Cover section 28 is similarly longitudinally spaced from a third cross-sectionally arcuate cover section 30 which is disposed at the inlet end of the trough. A removable cover section 32 extends longitudinally across the space between cover sections 26 and 28, bridging the two sections so as to fully cover the trough portion therebelow. Removable cover section 32 has an arcuate cross-section and its longitudinally-extending edges rest on cover frame 24. A similar cover member 34 is provided for the longitudinal space between cover sections 28 and 30.

A lifting eye member 36 is secured to and extends above cover section 28 and includes a pair of upwardly-extending spaced flanges through which transversely aligned apertures 38 are defined. A support bar 40 (shown only in end view in FIG. 4) is welded or otherwise secured to extend between apertures 38 and serves as a lifting point by which the discharge end of the trough can be lifted relative to the inlet end by means of a wire or rope 42.

A funnel 44, having its open end facing upward from the trough, is secured to extend through cover section 30 at the inlet end of the trough. The funnel 44 is normally disposed below the outlet for the various constituents to be dropped into the trough for mixing and delivery through discharge end 12. A pivot member 46 is also secured to cover section 30, slightly downstream of the funnel 44 and includes two (2) pivot arms 48 which project through the side wall of the funnel. Transversely aligned apertures 50 are defined in respective pivot arms 48 and are adapted to have a pivot bar journaled therein. Such pivot bar, not illustrated, is part of the constituent delivery unit, such as the vehicle described and illustrated in the aforementioned Zimmerman patent. It will be understood that such pivot bar provides an axis about which the trough may be pivoted by raising and/or lowering cable 42. As described in the Zimmerman patent, the pivot bar itself may be rotatable about an axis perpendicular to its own axis so that the trough may also be moved in a generally horizontal plane when pivoted about such axis.

An end plate 52 covers the inlet end of the trough while another end plate 54 covers only the upper portion of the discharge end of the trough so as not to block the discharge opening 12. A mover support plate 56 is secured to end plate 54 and supports a drive motor 58. Motor 58 drives a shaft 60 which extends longitudinally through the trough and is part of an auger unit having various spiral blade sections 62 and paddle sections 64 extending radially therefrom in the manner described in the aforementioned Futty, et al. patent.

The trough assembly as thus far described is entirely conventional and operates by receiving constituent components for concrete and, in the manner described in the aforementioned Zimmerman and Futty, et al. patents, mixes these components while transporting the mixture from the inlet end to the discharge end of the trough. Upon reaching the discharge end of the trough, the mixture is dropped at the desired onsite location or, as described below, into the chutes which are provided in accordance with the present invention.

The only portion of the structure described above which is not conventional are rails 18 and 20. These relate to the movable mounting relationship for the chute extensions to be described.

A primary extension chute 70 and a secondary extension chute 72 are stored in end-to-end relation below and partially surrounding the bottom wall 10 of the trough. Primary chute 70 has an inlet end disposed, in the stored position, below the inlet end of the trough; the discharge end of primary chute 70, in this position, is disposed proximate the longitudinal midpoint of the trough. Secondary chute 72 has its inlet end disposed in substantially abutting relationship with the outlet end of chute 70 and its outlet end is disposed proximate the discharge end of the chute but upstream of discharge outlet 12 so as not to impede outflow from the discharge outlet when the chutes are in the stored position.

In order to secure the chutes to the trough structure, a pair of pivot plates 74 are welded to transversely aligned opposite sides of the inlet end of the primary chute 70. Pivot plates 74 each have a pivot aperture defined in a portion of the pivot plate extending below the primary chute 70, the two pivot apertures being transversely aligned. These pivot apertures receive a pivot pin or bolt 76 in a journaled relationship. A pair of support plates 78 are disposed on opposite sides of the trough and, in the storage position of the chutes (illustrated in FIGS. 1 and 2) are disposed at the inlet end of the trough. Support plates 78 each have a first aperture which is aligned with the pivot apertures in pivot plates 74 and are secured to bolt or pivot pin 76 in a non-pivotal fashion. Therefore, pivot plates 74 are pivotal about pivot pin 76 relative to support plates 78. Another pair of aligned apertures in the support plates 78 receive a fastening bolt which holds the transversely separated support plates 78 in fixed transversely spaced position. As was described above, this precludes the slide member from disengaging from tracks 18 and 20.

The upper portion of each support plate 78 has a slide member 82 secured to or formed as a part thereof. Each slide member has a pair of longitudinally-extending channels which are adapted to slidably engage respective rails 18 and 20. The engagement of the rails by the channels in slide member 82 precludes vertical movement of support plates 78, and hence chutes 70 and 72, relative to the trough. On the other hand, as will be described in greater detail below, the slide member 82 permits the chutes 70 and 72 to be moved along with pivot plates 74 and support plates 78 longitudinally along the trough.

A pair of piston and cylinder type pneumatic hinges 84 are secured between the support plate 78 and approximately the mid-portion of primary chute 70. Each hinge 84 has its cylinder pivotally secured to support plate 78 and its piston pivotally secured to chute 70. The outlet end of chute 70 and the inlet end of chute 72 are pivotally engaged by means of a pair of pivot plates 86 which are fixedly secured to the outlet end of primary chute 70 and which pivotally engage brackets 88 secured proximate the inlet end of the second chute. Specifically, each bracket 88 and each pivot plate 86 are pivotally joined by means of a transversely extending pivot pin 90. A stop member 92 is secured to the bottom portion of the outlet end of primary chute 70 so as to uphold the corresponding portion of the inlet end of secondary chute 72 and thereby assure proper alignment when the chutes are intended to be oriented end-to-end.

Figure 5:
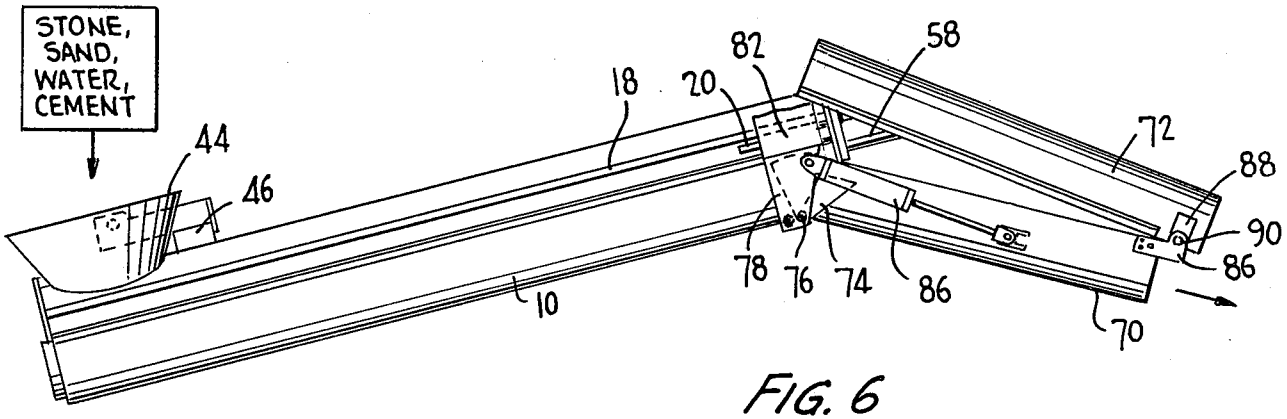
FIG. 5 is a diagrammatic illustration of the apparatus of FIG. 1 with the extension chutes in the deployed position and only one (1) chute being utilized.
Figure 6:
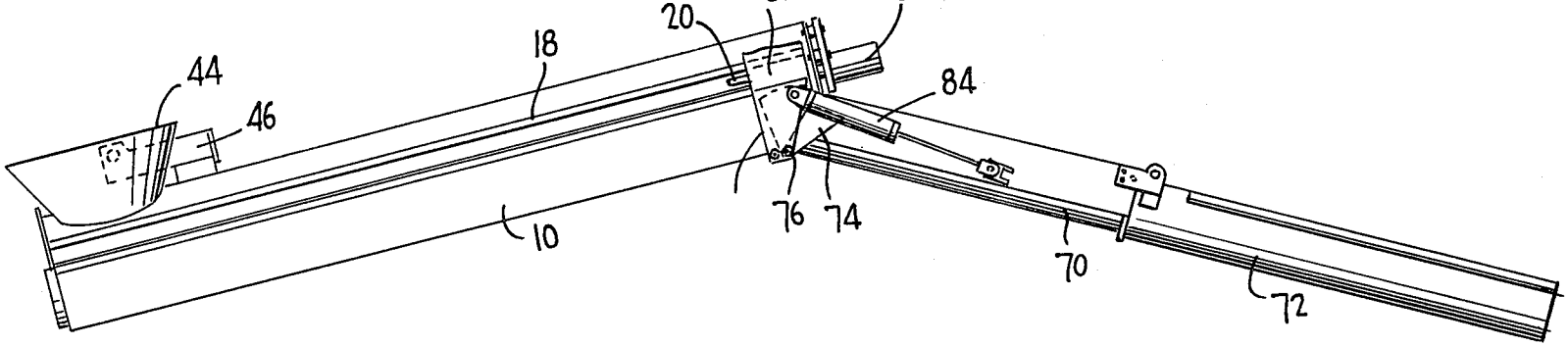
FIG. 6 is a diagrammatic view similar to that of FIG. 5 wherein both chutes are part of the delivery path.

Under circumstances wherein the trough is not long enough to reach the desired delivery location for the concrete or other mixture, the chutes 70 and/or 72 may be deployed by manually pulling on the chutes so as to cause slide member 82 to ride along rail 18 until the inlet end of primary chute 70 reaches the discharge end of the trough. This position, as illustrated in both FIGS. 5 and 6, places the inlet end of primary chute 70 beneath the discharge outlet 12 of the trough. Since the chutes are only secured to the trough assembly by means of the pivot engagement 76 and hinge 84, the extended chutes tend to pivot downwardly until limited in this pivotal motion by the fully extended hinges 84. This leaves the inlet end of primary chute 70 disposed at a higher level than the outlet end of chute 70 so that material dropping from discharge outlet 12 of the trough into the primary chute will be carried by gravity downwardly through the primary chute. In the embodiment illustrated in FIG. 5, only the length of chute 70 is required so that chute 72 is pivoted upwardly about pivot pin 90 so as to rest on the end plate of the trough. The material carried through primary chute 70 in this configuration is delivered to the site from the outlet end of this primary chute. If, on the other hand, a longer delivery path is required, secondary chute 72 is maintained in its end-to-end relationship with primary chute 70 as illustrated in FIG. 6 so that the force of gravity carries the delivered mixture along both chutes 70 and 72. The delivered mixture is thus delivered from the outlet end of the secondary chute 72. When the delivery is completed, the chutes may be readily washed and then, after being placed end-to-end, as illustrated in FIG. 6, put back under the trough causing slide member to slide along rail 18.

It is seen that the extension chutes 70 and 72 are easily and quickly deployed by simply sliding and pivoting as necessary. The length of the delivery path can therefore be changed to include three (3) different lengths. Of course, additional chutes may be similarly secured in end-to-end relationship from the outlet end of chute 72. The chutes are part of a permanent assembly with the trough and therefore are available for use when needed and cannot be misplaced.

While we have described and illustrated a specific embodiment of our invention, it will be clear that variations of the details of construction which are specifically illustrated and described may be resorted to without departing from the true spirit and scope of the invention as defined in the appended claims.

We claim:

1. An improved apparatus for mixing and delivering individual stored components which are selectively dispensed for delivery as a mixture, said apparatus comprising:

mixing means for receiving the dispensed ingredients, said mixing means comprising: an elongated trough having an inlet end and a discharge end; a rotatably driven auger disposed in said trough for transporting the dispensed ingredients from said inlet end to said discharge end while mixing the dispensed ingredients in transit; and drive means for selectively rotating said auger;

first and second elongated conveyor chutes, each having an ingress end and an egress end;

pivot means securing said egress end of said first chute to said ingress end of said second chute;

mounting means slidably securing said first chute to said trough for longitudinal slidable movement relative to said trough in longitudinally aligned end-to-end relation beneath the trough and in which free fall of the mixed ingredients from said discharge end of said trough is unimpeded by said first and second chutes, and a deployed position in which the ingress end of said first chute is disposed below said discharge end of said trough to receive mixed ingredients falling from said discharge end; and wherein pivot means includes further means permitting selective pivotal motion of said second chute relative to said first chute in said deployed position, said pivotal motion extending between first and second mutual orientations, said first and second chutes in said first orientation being disposed in longitudinal alignment, with the egress end of said first chute adjacent the ingress end of said second chute to permit free flow of mixed material from said first chute to said second chute, said second chute in said second orientation being positioned out of longitudinal alignment with said first chute to permit free fall of mixed ingredients from the egress end of said first chute.

2. The apparatus according to claim 1, wherein said further means joins the ingress end of said second chute to the egress end of the first chute to permit pivotal movement of the second chute about a pivot axis extending transversely of the longitudinal dimension of said first and second chutes, and wherein said second chute in said second orientation is pivoted to displace the ingress end of the second chute from the egress end of the first chute.

3. The apparatus according to claim 2, wherein said second chute in its second orientation is disposed above said first chute.

4. The apparatus according to claims 2 or 3, wherein said pivot means comprises:

a pair of pivot plates fixedly secured to opposite sides of said first chute, each having an extended portion projecting longitudinally beyond the egress end of the first chute, said extended portion having an aperture defined therethrough transversely to the longitudinal dimension of the chute, and wherein the apertures in the extended portions of both pivot plates are aligned transversely to the first chute to define said pivot axis;

apertured means secured at transversely aligned locations of said second chute proximate its ingress end along said pivot axis; and pivot pin means extending through the aligned apertured means and extended portion apertures on each side of said chutes for engaging said chutes for mutual pivotal movement about said pivot axis.

5. The apparatus according to claim 1, wherein said slide means comprises:

first and second rail means extending longitudinally along opposite sides, respectively, of said trough;

first and second slide members slidably engaging respective rail means; and connecting means securing said slide member to said first chute proximate the ingress end of said first chute.

6. The apparatus according to claim 5, wherein said connecting means comprises:

means pivotally engaging each slide member and said first chute for permitting pivotal movement of said first chute relative to said slide member about a first pivot axis extending transversely of said first chute at a location proximate the ingress end of said first chute; and expansible support means for supporting the first chute from said slide member at different rotational positions of said first chute relative to said slide member in the deployed position of said first chute.

7. The apparatus according to claim 6, wherein said expansible support means comprises first and second pneumatic piston and cylinder assemblies, wherein each cylinder is pivotally secured with respect to a respective slide member for pivotal movement about a still further axis extending transversely of the first chute length, and wherein each piston is secured to a respective side of said first chute.

8. The apparatus according to claim 1, wherein said first chute, in said deployed position, extends at an angle downward from the longitudinal dimension of the trough.

9. The apparatus according to claim 1, wherein said mixing means is secured to a mobile assembly for separately storing and selectively dispensing said individual components.

* * * * *